US005125176A

United States Patent [19]

Toraby-Payhan

[11] Patent Number: 5,125,176

[45] Date of Patent: Jun. 30, 1992

[54] NUMERAL DISPLAY DEVICE

[76] Inventor: Reza Toraby-Payhan, 1889 N. 105th E. Ave., Tulsa, Okla. 74116

[21] Appl. No.: 576,619

[22] Filed: Aug. 31, 1990

Related U.S. Application Data

[63] Continuation-in-part of Ser. No. 537,694, Jun. 14, 1990.

[51] Int. Cl.[5] ..... G09F 11/00

[52] U.S. Cl. ..... 40/450; 40/446; 40/449; 40/470; 40/471

[58] Field of Search ..... 40/446, 447, 449, 450, 40/470, 471, 477

[56] References Cited

U.S. PATENT DOCUMENTS

| | | | |
|---|---|---|---|
| 1,782,328 | 11/1930 | Wearham | 40/477 |
| 2,433,456 | 12/1947 | Jansen . | |
| 2,439,553 | 4/1948 | Winn | 350/267 |
| 2,489,751 | 11/1949 | Chandler . | |
| 2,986,982 | 6/1961 | Kaprelian . | |
| 3,200,525 | 7/1965 | Francis . | |
| 3,273,270 | 9/1966 | Skrobish . | |
| 3,521,946 | 7/1970 | Wrench . | |
| 3,537,197 | 11/1970 | Smith | 40/449 |
| 3,582,907 | 6/1971 | Taylor . | |
| 3,764,200 | 10/1973 | Glattli . | |
| 3,789,525 | 2/1974 | Bugg | 40/450 |
| 3,814,506 | 2/1974 | Bogg . | |
| 4,024,532 | 5/1977 | Sherwin | 40/450 |
| 4,164,824 | 8/1968 | Nidelkoff . | |
| 4,220,948 | 9/1980 | Trame . | |
| 4,507,888 | 4/1985 | Robinson et al. | 40/449 |
| 4,539,768 | 9/1985 | Halliday . | |
| 4,627,182 | 12/1986 | Weiss . | |
| 4,693,025 | 9/1987 | Landin | 40/477 |
| 4,777,747 | 10/1988 | Murray, Jr. . | |
| 4,796,370 | 1/1989 | Chang . | |

*Primary Examiner*—Kenneth J. Dorner
*Assistant Examiner*—Milton Nelson, Jr.
*Attorney, Agent, or Firm*—Head & Johnson

[57] ABSTRACT

A numeral display device having at least one visible face. Each segment of the device has a transparent outer pane and a spaced, parallel inner pane forming a pocket, a first portion of the pocket being aligned with and visible through an opening in the face. A flexible film is received in each pocket. A mechanism is provided to insert and withdraw each film from the first portion of each pocket so that each segment will either contrast with or match the face.

5 Claims, 17 Drawing Sheets 55
53
53
40
24
3
26
22
40
12

60
62
58
62
62
7
63
76
12'

NUMERAL DISPLAY DEVICE

RELATIONSHIP TO OTHER APPLICATIONS

This is a continuation-in-part of application Ser. No. 07/537,694, filed Jun. 14, 1990 entitled "Numeral Display Device".

BACKGROUND OF THE INVENTION

1. Field of the Invention

The present invention relates to a numeral display device wherein individual segments arranged to comprise each numeral may be selectively lightened, darkened, or changed in color from the surrounding background in order to make the desired numeral visible. In particular, the present invention relates to a numeral display device having self-storing segments.

2. Prior Art

The system of seven segment numerals has heretofore been widely used, both with manually changeable segments and with liquid crystal displays. The individual segments are lightened or darkened depending on the desired numeral to be formed from 0 to 9. Liquid crystal displays have been found to be adequate for small devices viewed at short distances but are difficult to see in large devices viewed at longer distances.

The present invention is not constrained to small displays and may readily be adapted to large highway signs. Additionally, the present invention provides a display device that may be remotely controlled.

Applicant has conducted a patent search and is aware of the following U.S. patents:

| U.S. Pat. No. | PATENTEE | ISSUE DATE |
|---|---|---|
| 2,439,553 | Winn | April 13, 1948 |
| 3,200,525 | Francis | August 17, 1965 |
| 3,582,907 | Taylor | June 1, 1971 |
| 3,521,946 | Wrench | July 28, 1970 |
| 2,986,982 | Kaprelian | June 6, 1961 |
| 2,433,456 | Jansen | December 3, 1947 |
| 2,489,751 | Chandler | November 29, 1949 |
| 4,796,370 | Chang | January 10, 1989 |
| 4,164,824 | Nidelkoff | August 21, 1979 |
| 3,273,270 | Skrobisch | Sept. 20, 1966 |
| 4,777,747 | Murray, Jr | October 18, 1988 |
| 4,627,182 | Weiss | December 9, 1986 |
| 4,539,768 | Halliday | Sept. 10, 1985 |
| 3,764,200 | Glättli | October 9, 1973 |
| 3,814,506 | Steele | June 4, 1974 |
| 3,789,525 | Bugg | February 5, 1974 |
| 4,220,948 | Trame | September 2, 1980 |
| 4,024,532 | Sherwin | May 17, 1977 |

Kaprelian (U.S. Pat. No. 2,986,982) discloses a pair of spaced glass plates. A center opening is connected by a tube to a pump in order to move opaque fluid from a tank. In the normal pumping condition, light cannot pass through the fluid. To open, the pump sends air through the tube which fills the space and allows light to pass therethrough.

Sherwin (U.S. Pat. No. 4,796,370) discloses a multi-element display wherein each element ma be reversibly rotated about a mounting rod by an electric motor.

Nidelkoff (U.S. Pat. No. 4,164,824) illustrates one of the problems overcome in the present invention. A self-storing display allows each shutter to be received in a linear pocket so that it may be manually slid to a retracted position where the back plate is revealed.

When the shutter is retracted, there must be sufficient space behind the background face to accommodate it.

Skrobisch (U.S. Pat. No. 3,273,270) discloses a segmented display wherein each segment is longitudinally divided and pivots to fold together to conceal its face. A linear actuator is shown in FIG. 20 and 21 having a pinion gear that meshes with a rack.

Murray (U.S. Pat. No. 4,777,747) provides each segment of a seven segment display with a guide rim or flange overlapping edge to slidably receive an element that may be manually inserted or removed.

Weiss (U.S. Pat. No. 4,627,182) provides a two sided display element that may be rotated by the force of voltage applied to a crystal.

Halliday (U.S. Pat. No. 4,539,768) shows a seven segment display with a flap for each segment that may be manually pivoted to cover or uncover with assistance of spring-loaded pivots.

Chang (U.S. Pat. No. 4,796,370) shows a seven segment display wherein each segment has a transverse axle that may be rotated by a small electric motor.

Glättli (U.S. Pat. No. 3,764,200) discloses a cylindrical reflecting surface with an axially extending slot that has a flat planar element movable up or down to make the surface appear illuminated.

Steele (U.S. Pat. No. 3,814,506) provides panels having a pair of outer sheets with a third, center sheet slidably sandwiched therebetween. The center sheet is movable by a cam and lever mechanism.

Bugg (U.S. Pat. No. 3,789,525) discloses a pair of resilient film loops wherein one end of each loop is fixed in contiguous relation to a movable frame so that the film loops may be brought into and out of a visible position.

Trame U.S. Pat. No. 4,220,948 provides a sliding shutter between front and back plates with a tab extending through a opening to manually slide the shutter.

Accordingly, it is an object and purpose of the present invention to provide a numeral display device which is compact in design and wherein its individual segments are self-storing and easily changeable.

SUMMARY OF THE INVENTION

The numeral display device includes a background face from which the numerals contrast. Each numeral comprises seven discreet segments which are arranged to form all of the numerals from 0 through 9.

Each segment includes a transparent outer pane and an inner pane which is parallel to and spaced from the outer pane. A spacer or spacers keep the inner pane in spaced relation to the outer pane in order to form a continuous pocket. A first portion of the pocket is aligned with the background face and is visible from the exterior of the display device. A second portion of the pocket is in angular relation to the first portion and is not visible but interior to the device.

A thin flexible film is allowed to travel within the pocket provided between the panes. When the film fills the first portion, the segment will match the color of the surrounding background face of the display. Conversely, when the film is withdrawn from the first portion of the pocket, the inner pane will be visible and the segment will contrast with the background.

In one embodiment, a slot is provided in the outer pane on the second portion so that the film is accessible. Affixed to the film where the slot provides an opening is a flat rack having protruding teeth. A motor having an extending rotating shaft terminates in a pinion gear which mesh with the teeth on the rack. Rotation of the pinion gear by the motor moves the rack linearly and, in turn, moves the film.

In a second embodiment, the extending shaft of the motor terminates in a pulley which rotates rollers in contact with the film to move the film into or out of the first portion.

In a third embodiment, a metal strip is affixed to the leading edge of the film. A magnet manipulated by an operator exterior to the display device moves the metal strip and the accompanying film into or out of the first portion.

In a fourth embodiment, each pocket is fluid tight and filled with a fluid. The film may be moved by a motor engaging an actuator arm to move a magnet that travels within a track exterior to the pocket. The magnet attracts a metal guide affixed to the film within the pocket. Alternatively, a magnet exterior to the display device may be manipulated by an operator to move the film.

DETAILED DESCRIPTION OF THE PREFERRED EMBODIMENTS

Figure 1:
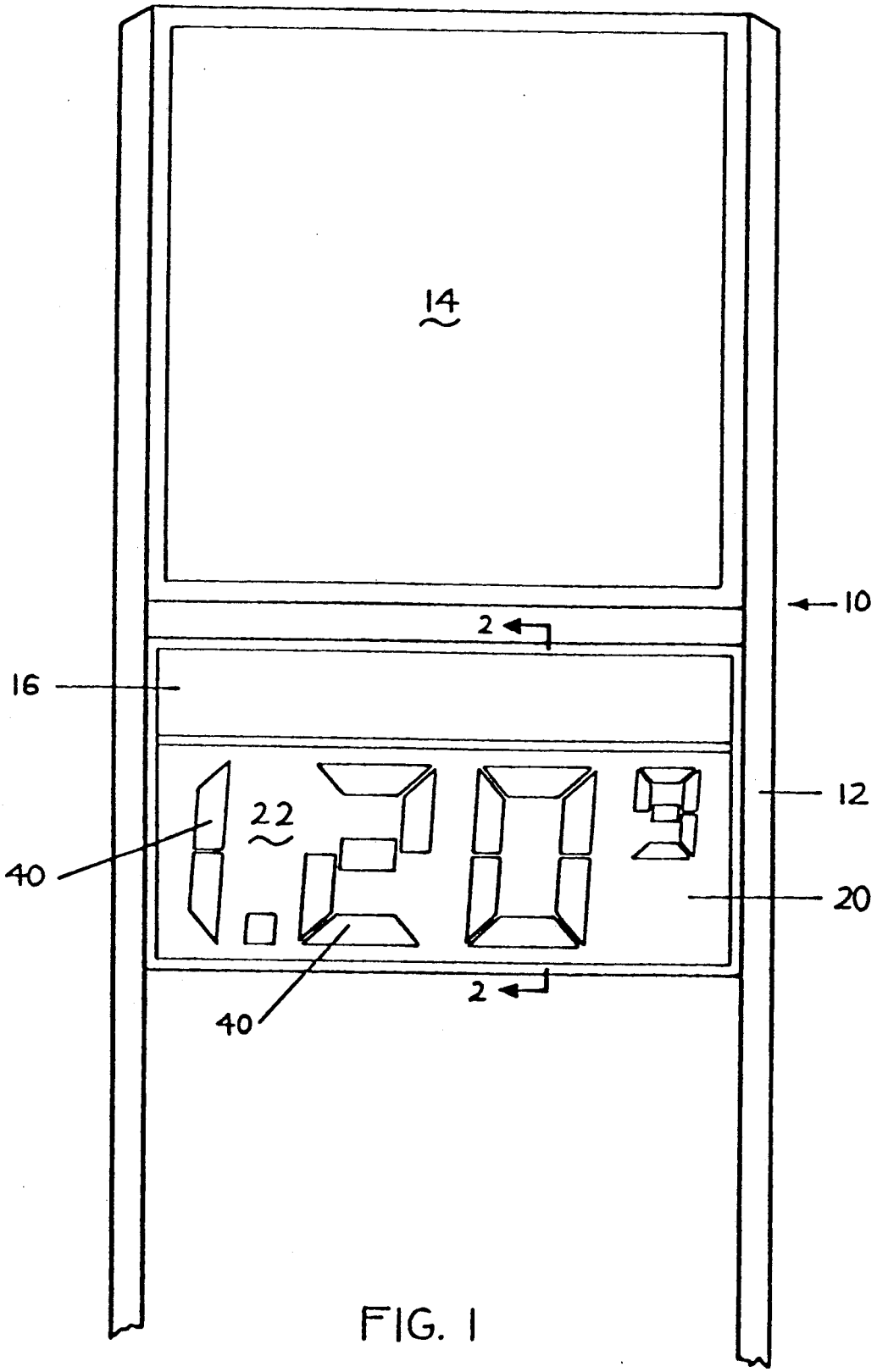
FIG. 1 is a perspective view of a first embodiment of a numeral display device constructed in accordance with the present invention.

Referring to the drawings in detail, FIG. 1 shows a highway sign structure 10 utilizing the invention. The sign structure 10 would be adjacent a street or highway in order to be visible to passing motorists. In addition to the visible display seen in FIG. 1, the structure 10 may include an additional identical display (not shown in FIG. 1) on the reverse side so that a display would be visible to motorists from both sides of the highway.

The sign structure 10 includes a frame 12. The structure 10 may also include a brand or vendor identification display 14 as well as a product identification display 16. In the present embodiment, the numeral display device 20 displays the price of motor fuel. It may be necessary to change the posted price of the fuel several times per day. At the same time, the size of the structure is such that the numeral display device may not be easily reached by personnel from the ground.

The numeral display device 20 includes a background face 22 from which the numerals displaying the price contrast. The background face may be constructed of aluminum, plastic, or other thin, lightweight material. The display may also be back-lighted from the interior of the frame 12. Each numeral comprises seven discreet segments. The individual segments may be lightened, darkened or changed in color from the surrounding background color. The segments are arranged to form all of the arabic numerals from 0 through 9. For example, each of the seven segments will be visible in order to form the numeral 8.

It should also be appreciated that the present invention can be easily adapted to display letters or other elements.

Figure 2:
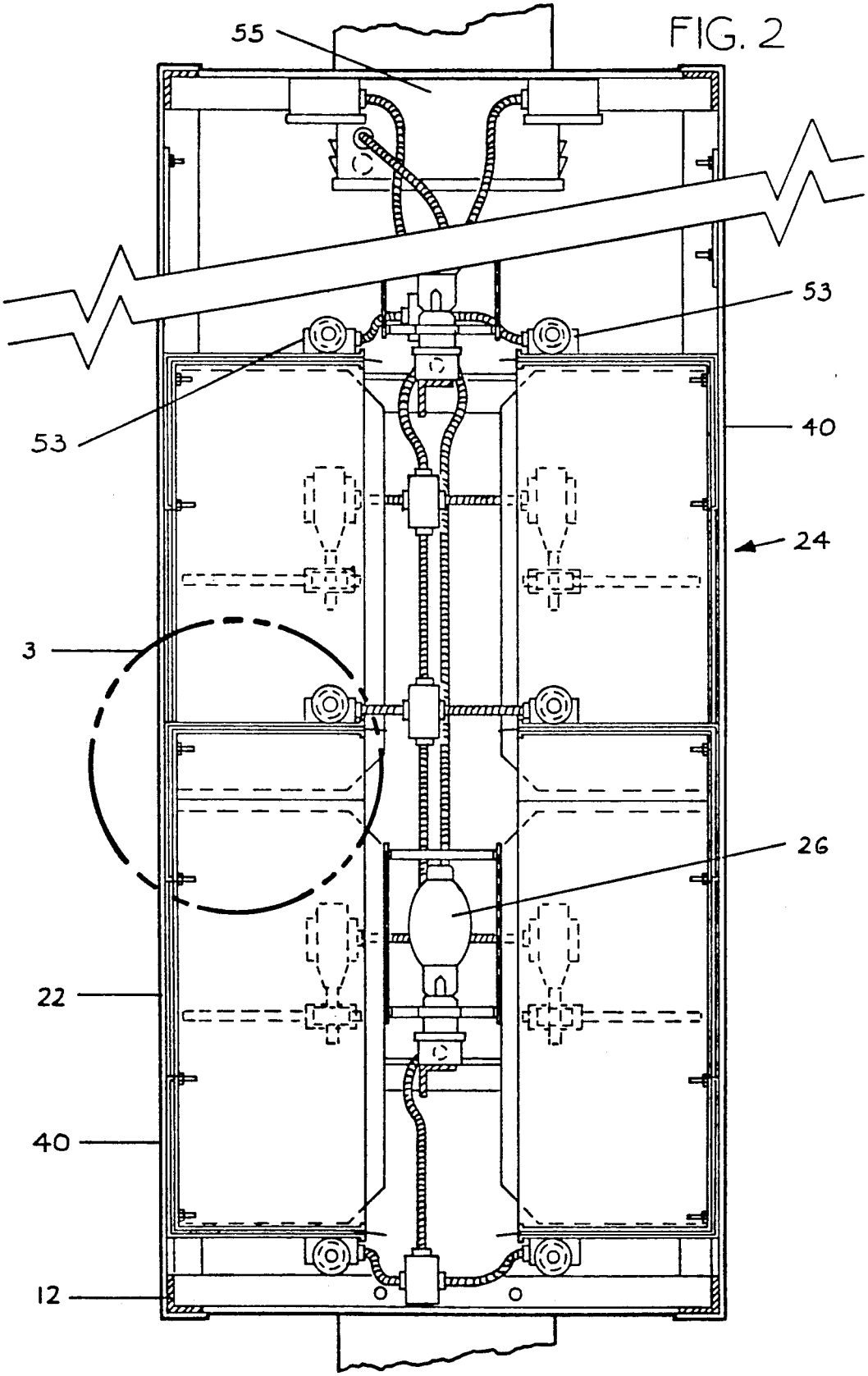
FIG. 2 is a sectional view taken along section line 2—2 of FIG. 1.

One embodiment 24 of the present invention is shown in FIGS. 1, 2, 3 and 4. FIG. 2 is a sectional view taken along section line 2—2 of FIG. 1. Internal illumination from a light source 26 makes the display device easily visible at night.

Figure 3:
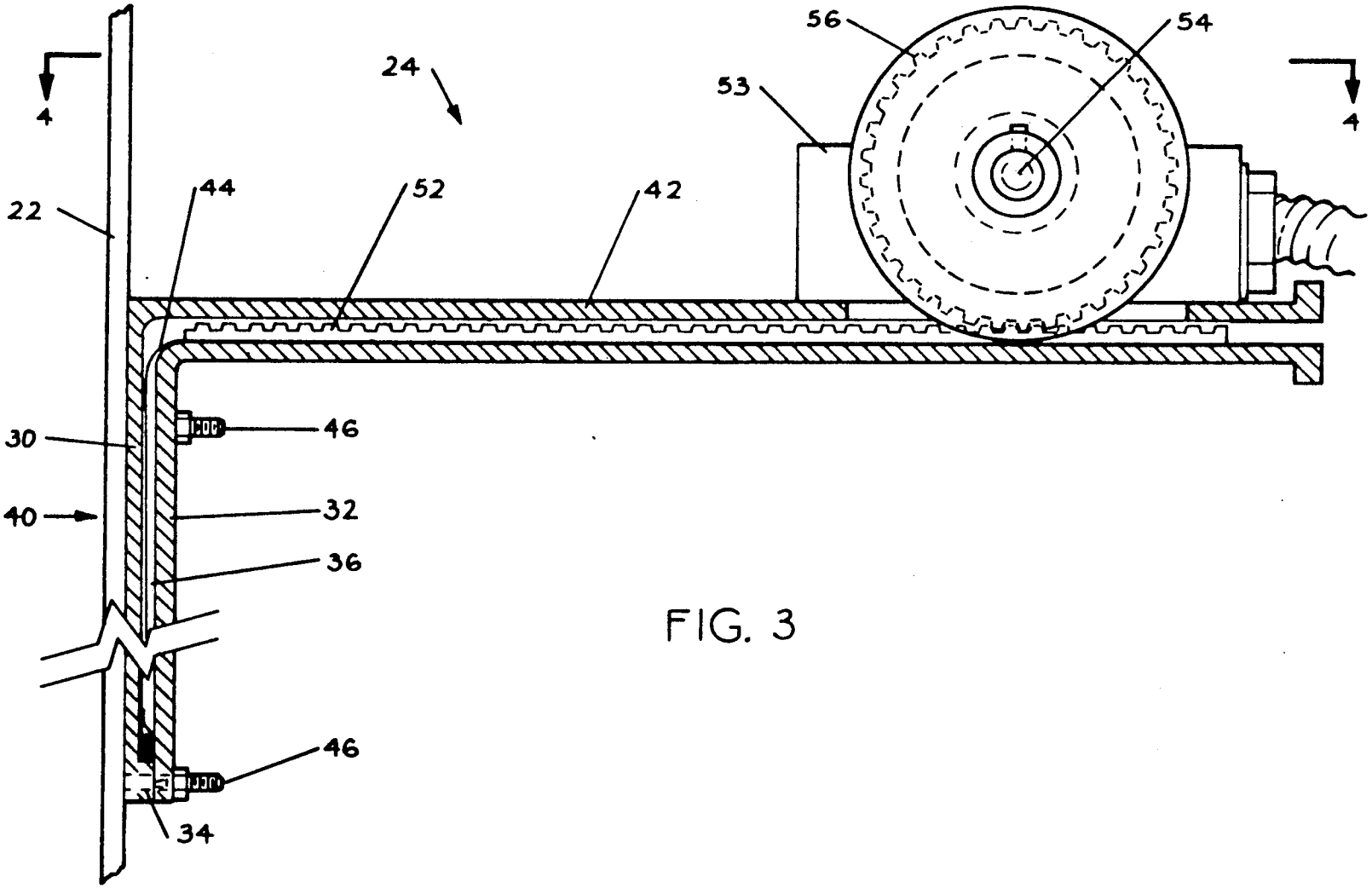
FIG. 3 is an enlarged view taken from the dashed circular line shown in FIG. 2.

FIG. 3 shows an enlarged view of one segment. It will be appreciated that each segment operates in a similar fashion and the description of one segment herein applies to the other segments. Each segment includes a transparent outer pane 30. An inner pane 32 is parallel to and spaced from the outer pane. In the present embodiment, a color will be chosen for the inner pane which contrasts with the background face 22. The inner pane and outer pane may be constructed of a rigid plastic material such as Lexan. A spacer or spacers 34 keep the inner pane in spaced relation to the outer pane in order to form a continuous pocket 36.

A first portion 40 of the panes 30 and 32 and the resulting continuous pocket 36 are aligned with an opening in the background face 22. This first portion 40 is visible from the exterior and constitutes one of the segments visible in the display.

A second portion 42 of the panes 30 and 32 and the resulting continuous pocket 36 is in an angular relation to the first portion 40. In the present embodiment, the second portion 42 is at a 90 degree angle to the first portion 40. The second portion is not visible from the exterior of the display and is interior to the frame 12. As will be appreciated from the description herein, the angular relationship of the first portion to the second portion allows each segment to take up reduced space along the background face 22.

A film of mylar or other thin, flexible material 44 is allowed to travel within the continuous pocket provided between the panes. The film 44 will be opaque and of the same color as the background face 22. When the film 44 fills the first portion 40, the segment will match the color of the surrounding background face of the display. Conversely, when the film is slidably withdrawn from the first portion of the pocket, the inner pane 32 will be visible. The segment will then contrast with the background and will be visible from the exterior. Alternatively, the device could be constructed so that the film could be of a contrasting color to the background and the inner pane could be of the same color.

Each segment may be secured to the background face 22 through fasteners 46. Thus secured, the background face provides a barrier to water or dirt entering the interior of the device 20.

Figure 4:
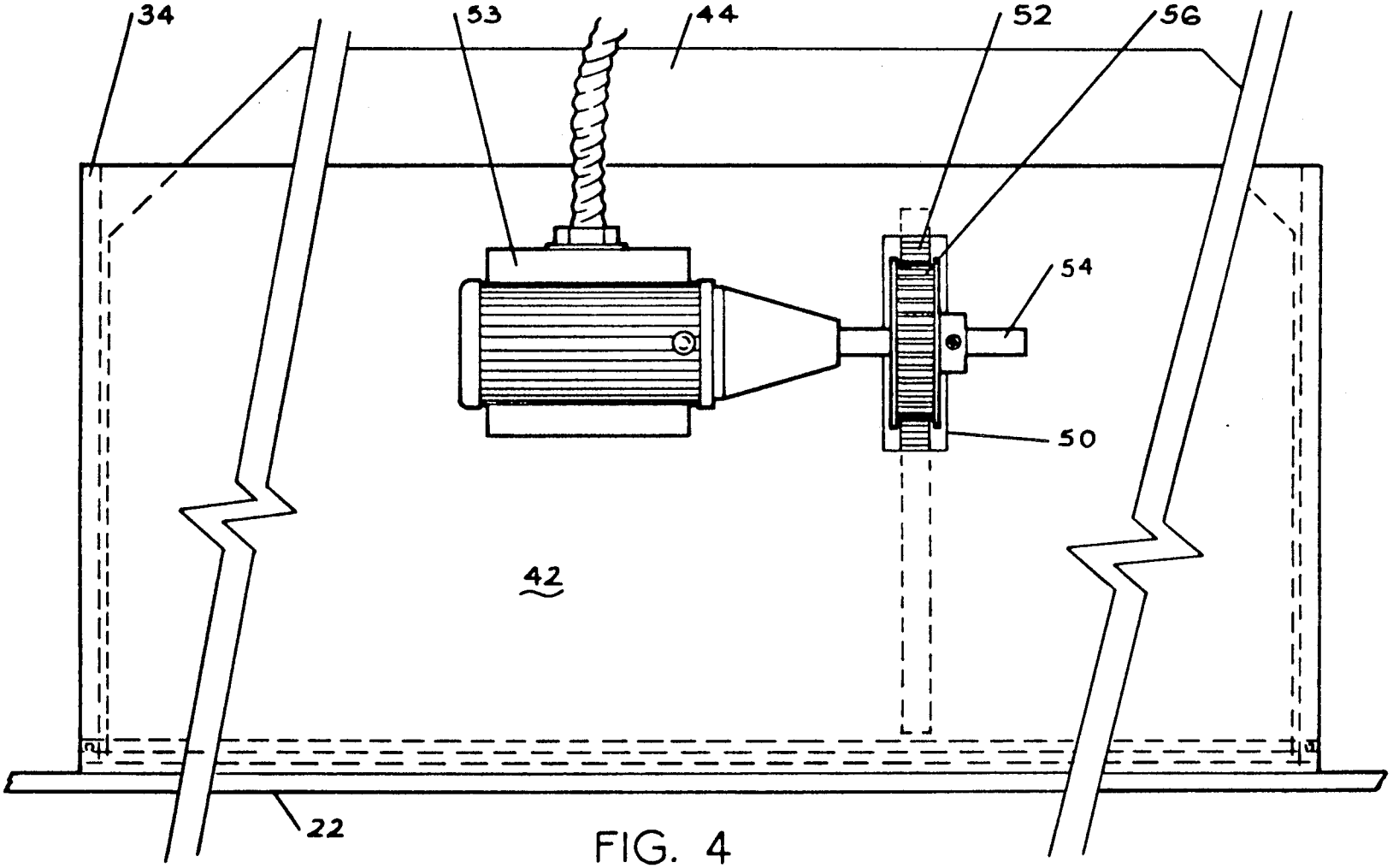
FIG. 4 is a sectional view taken along section line 4—4 of FIG. 3.
Figure 5:
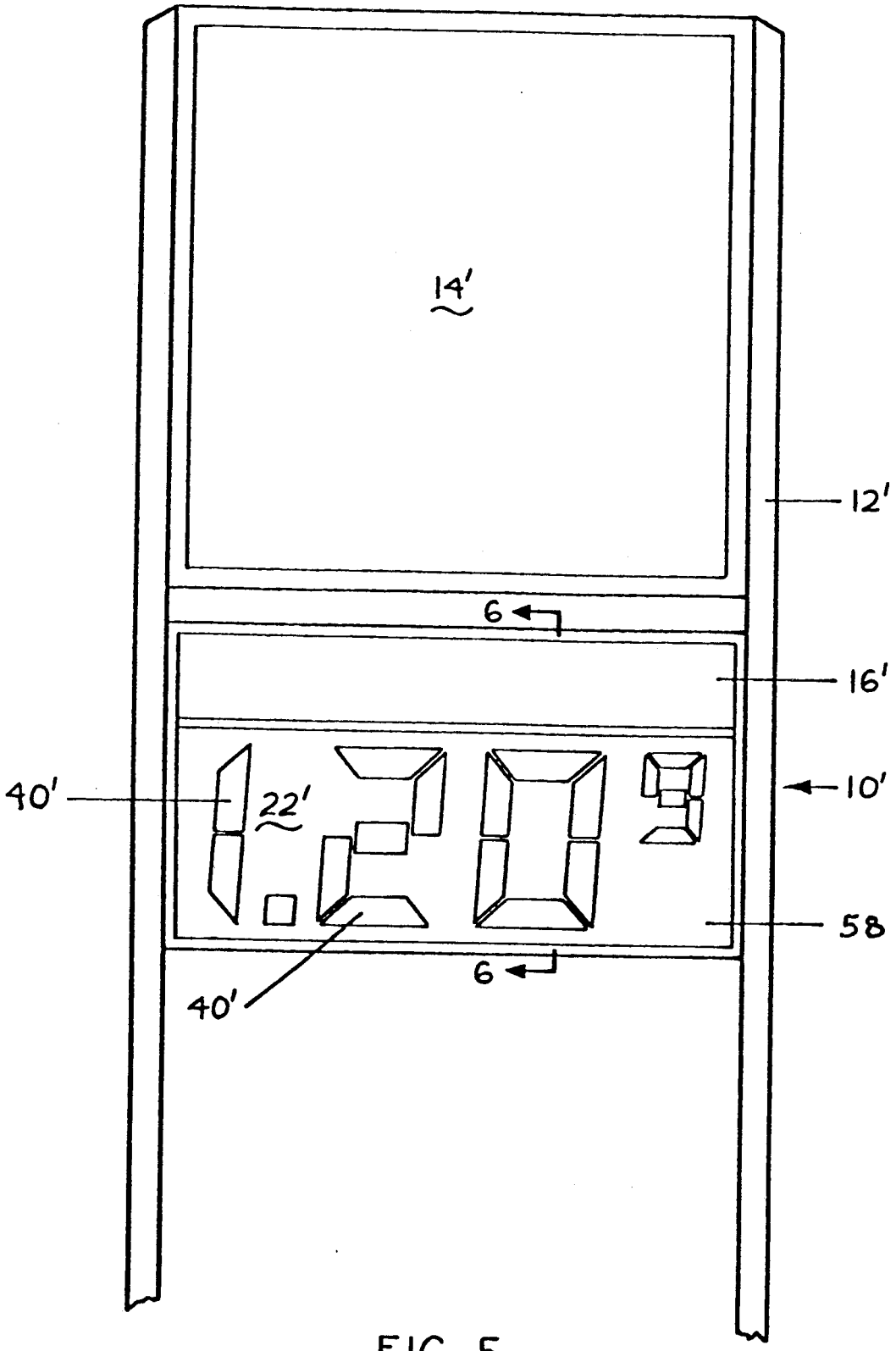
FIG. 5 is a perspective view of a second embodiment of a numeral display device constructed in accordance with the present invention.
Figure 6:
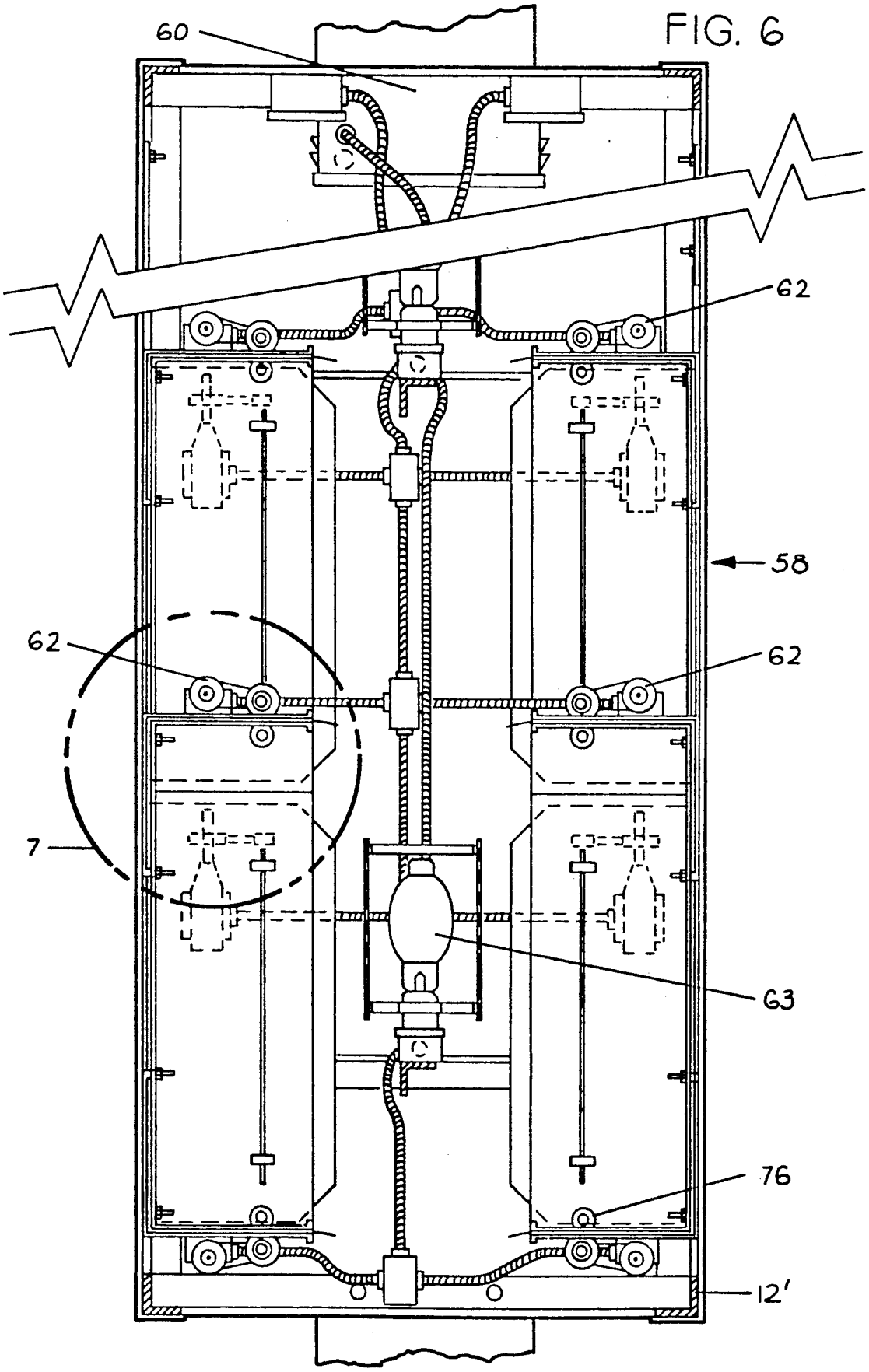
FIG. 6 is a sectional view taken along section line 6—6 of FIG. 5.

FIG. 4 is a sectional view taken along section lines 4—4 of FIG. 3. A slot 50 is provided in the outer pane 30 along the second portion 42 so that the film 44 is accessible. Affixed to the film where the slot provides an opening is a flat rack 52 having protruding teeth.

With reference to FIGS. 2, 3, and 4, an electric motor 53 has an extending rotating shaft 54. The small, lightweight motor may be mounted on the second portion 42. A low voltage direct current motor may be powered by household alternating electric current passed through a transformer 55. The rotating shaft terminates in a pinion gear 56 which mesh with the teeth on the rack 52. Accordingly, rotation of the pinion gear 56 by the motor moves the rack 52 linearly. Movement of the rack 52, in turn, slidably moves the film 44 within the continuous pocket.

When the gear 56, moves in the direction indicated by arrow 58, the film 44 will move into the first portion 40. Conversely, when the gear moves in the direction indicated by arrow 60, the film will move out the first portion 40.

The film 44 will be flexible enough to easily negotiate the angle between the first portion and the second portion as it travels.

As seen in FIG. 4, the spacers 34, positioned along the edges of the panes, are opaque so as not to allow leakage of light from the light source 26 interior to the display to the exterior.

The motor 53 will be connected to a control mechanism (not shown) which will control power to the motor and control its direction. The control mechanism will control each motor corresponding to the seven segments that comprise a numeral.

Switches (not shown) for the control mechanism may be remotely located so that the numerals may be quickly and conveniently changed as desired.

Figure 7:
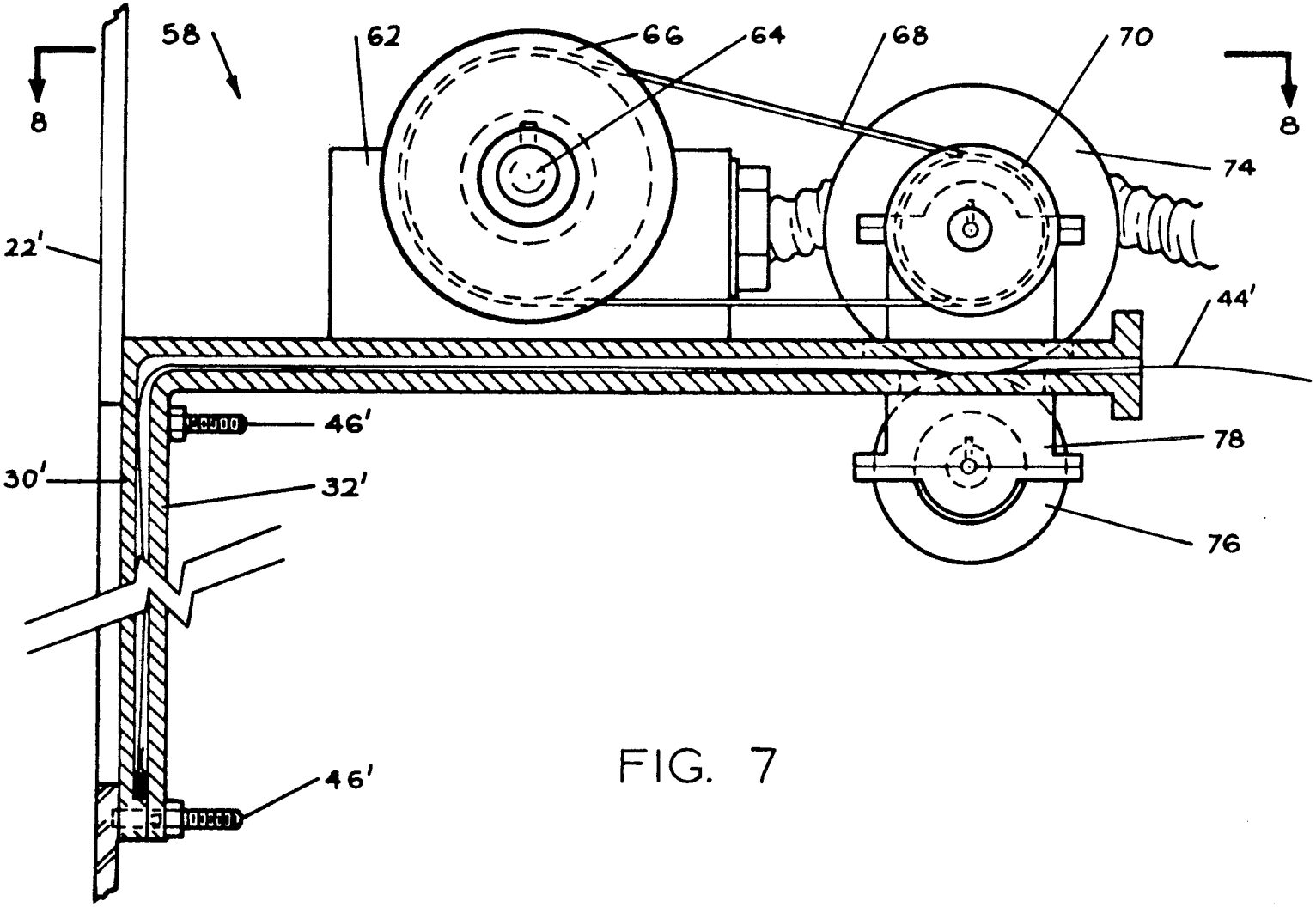
FIG. 7 is an enlarged view showing the portion within the circular dashed line in FIG. 6.
Figure 8:
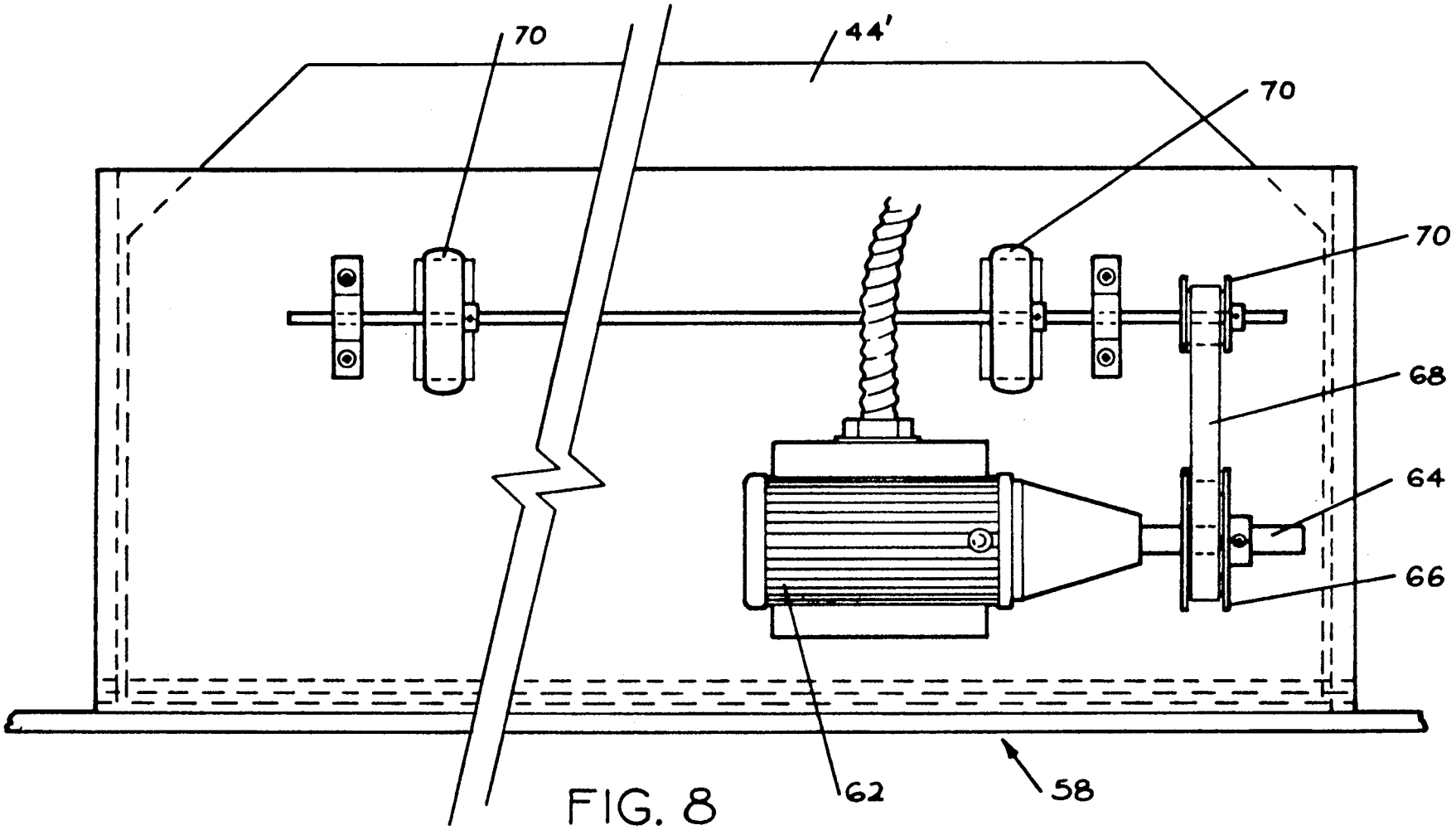
FIG. 8 is a sectional view taken along section line 8—8 of FIG. 7.

Another, second embodiment 58 is shown in FIGS. 5, 6, 7 and 8. The frame 12' and background face 22' would be similar to the previously described embodiment. A sectional view, taken along section lines 6—6 of FIG. 5, can be seen in FIG. 6. Relays and transformers 60 bring low voltage power to each electric motor 62. Internal illumination from a light source 63 makes the display easily visible at night. With particular reference to FIGS. 7 and 8, the rotating shaft 64 of the motor 62 terminates in a first pulley 66 which moves a continuous belt 68. Movement of the belt rotates a second pulley 70 which rotates a pair of drive wheels 74 that rest snugly against the film 44'. Opposite the drive wheels 74 are free rotation wheels 76 which keep the film 44' snug against the drive wheels. The free rotation wheels are held in place by brackets 78.

Rotation of the drive wheels 74 by the motor 62 will cause the film 44' to slide within the continuous pocket 36'. As previously described, the film 44' will be flexible enough to negotiate the angle between the first portion and second portion.

Figure 9:
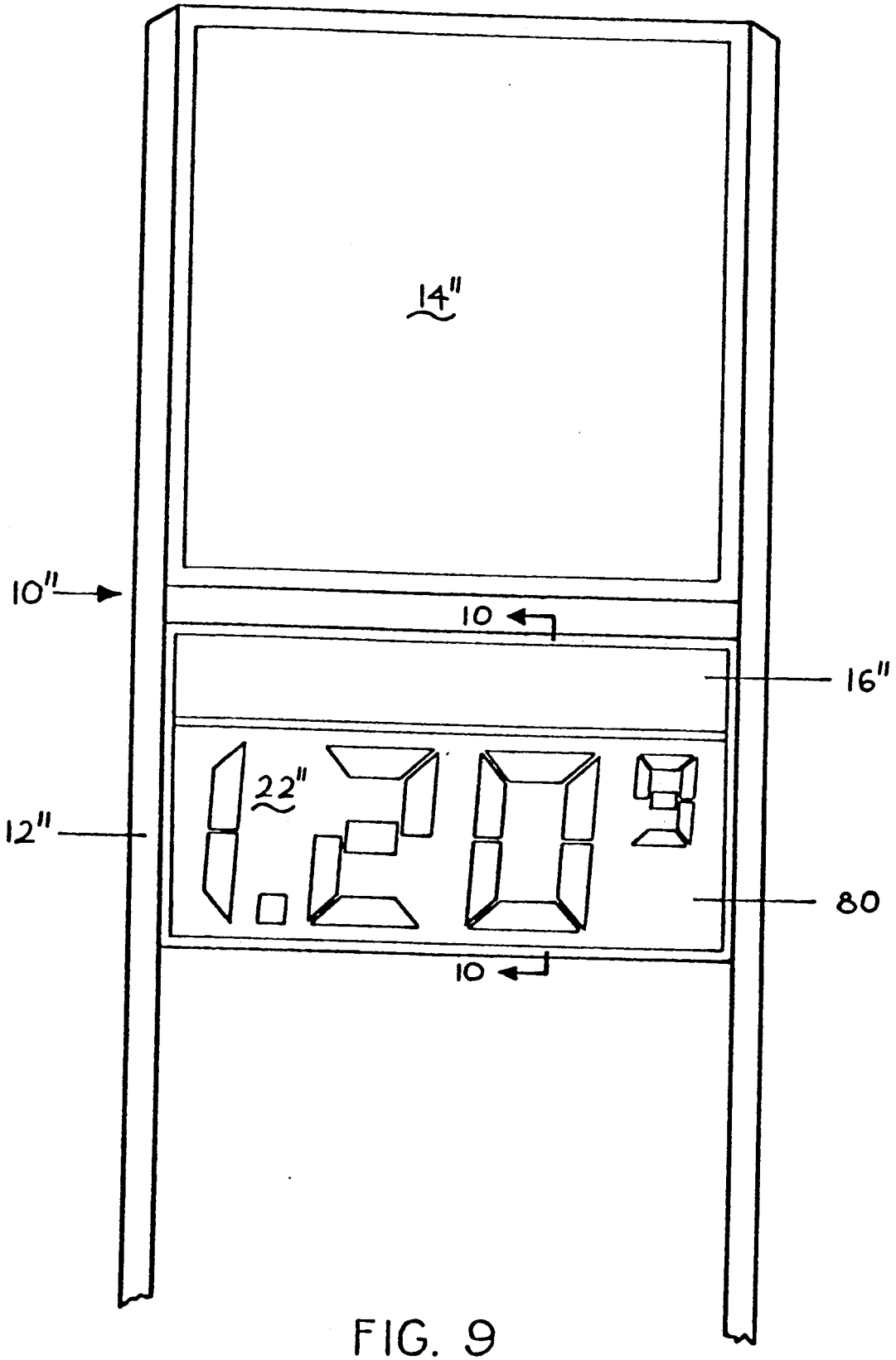
FIG. 9 is a perspective view of a third embodiment of a numeral display device constructed in accordance with the present invention.
Figure 10:
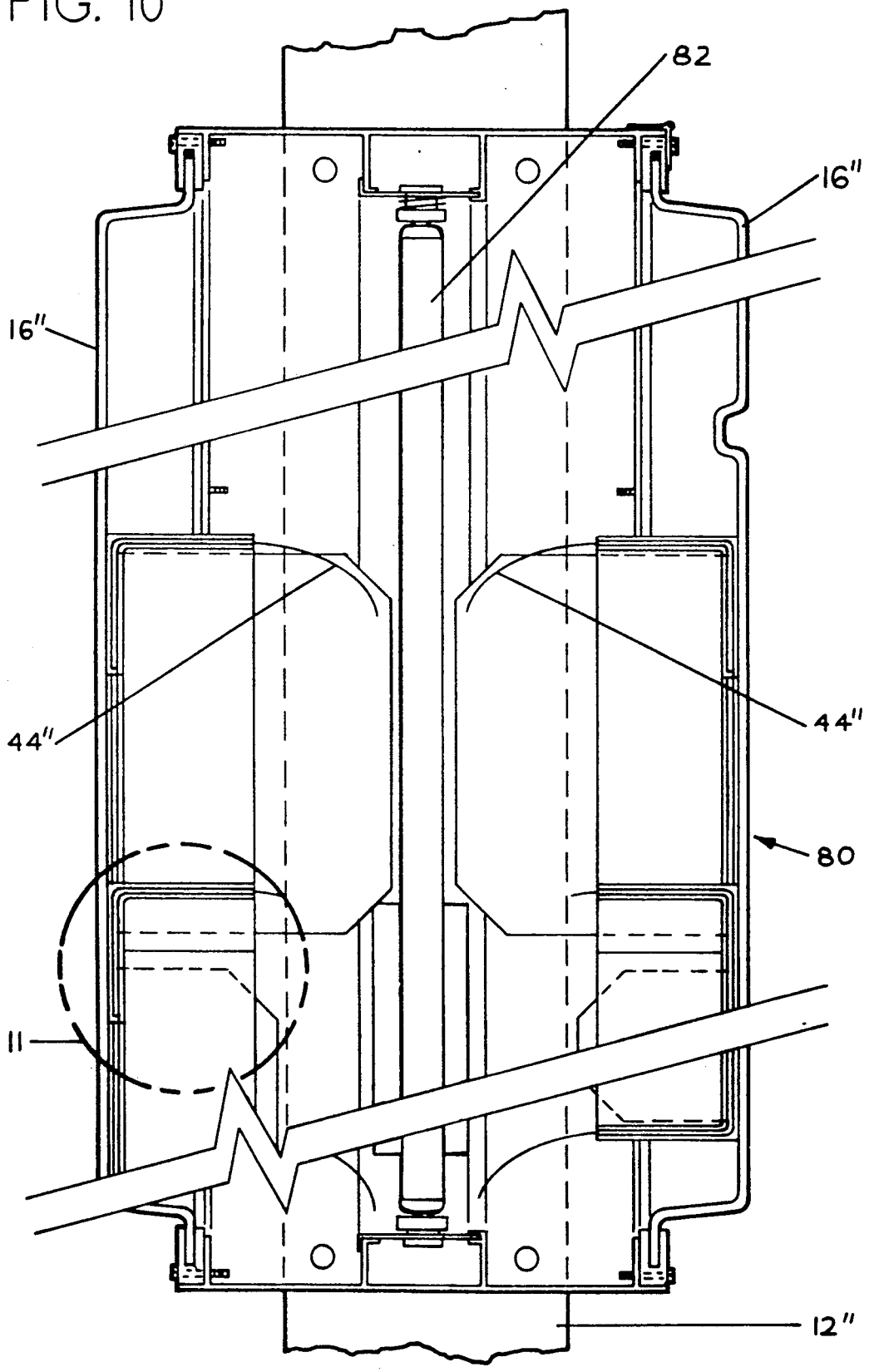
FIG. 10 is a sectional view taken along section line 10—10 of FIG. 9.
Figure 11:
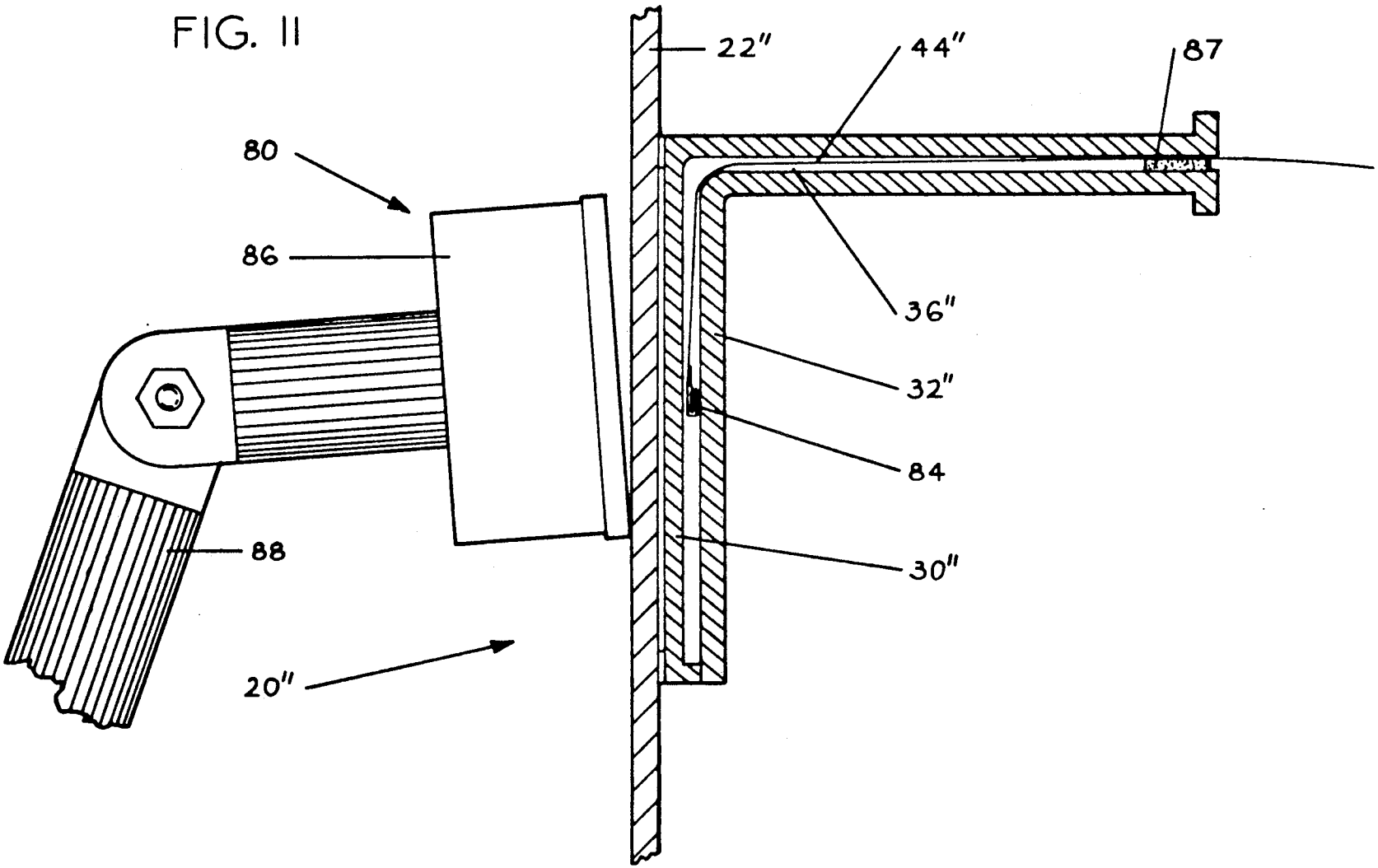
FIG. 11 is an enlarged view of a portion indicated by the circular dashed line in FIG. 10.

A further, third embodiment 80 is shown in FIGS. 9, 10, and 11. The frame 12'' and background face 22'' from which the numerals contrast would be similar to the previous embodiments. As seen in the sectional view of FIG. 10, there are no motors or mechanized means to move the films 44''. Internal illumination from a light source 82 makes the display easily visible at night.

As best seen in FIG. 11, a thin metal strip 84 is affixed to each film 44'' at its front edge. When a magnet 86, exterior to the display 20'', is moved near the background face 22'', the metal strip 84 and its accompanying film 44'', will be caused to move within the continuous pocket 36''. Since the outer pane 30'' is composed of a plastic material, the magnetic field passes easily therethrough. A pad 87 within the continuous pocket 36'' retains the film 44'' in place until moved by the magnet.

The magnet 86 may be attached to a pole 88, so that an operator (not shown) can easily change the segments of the display.

Figure 12:
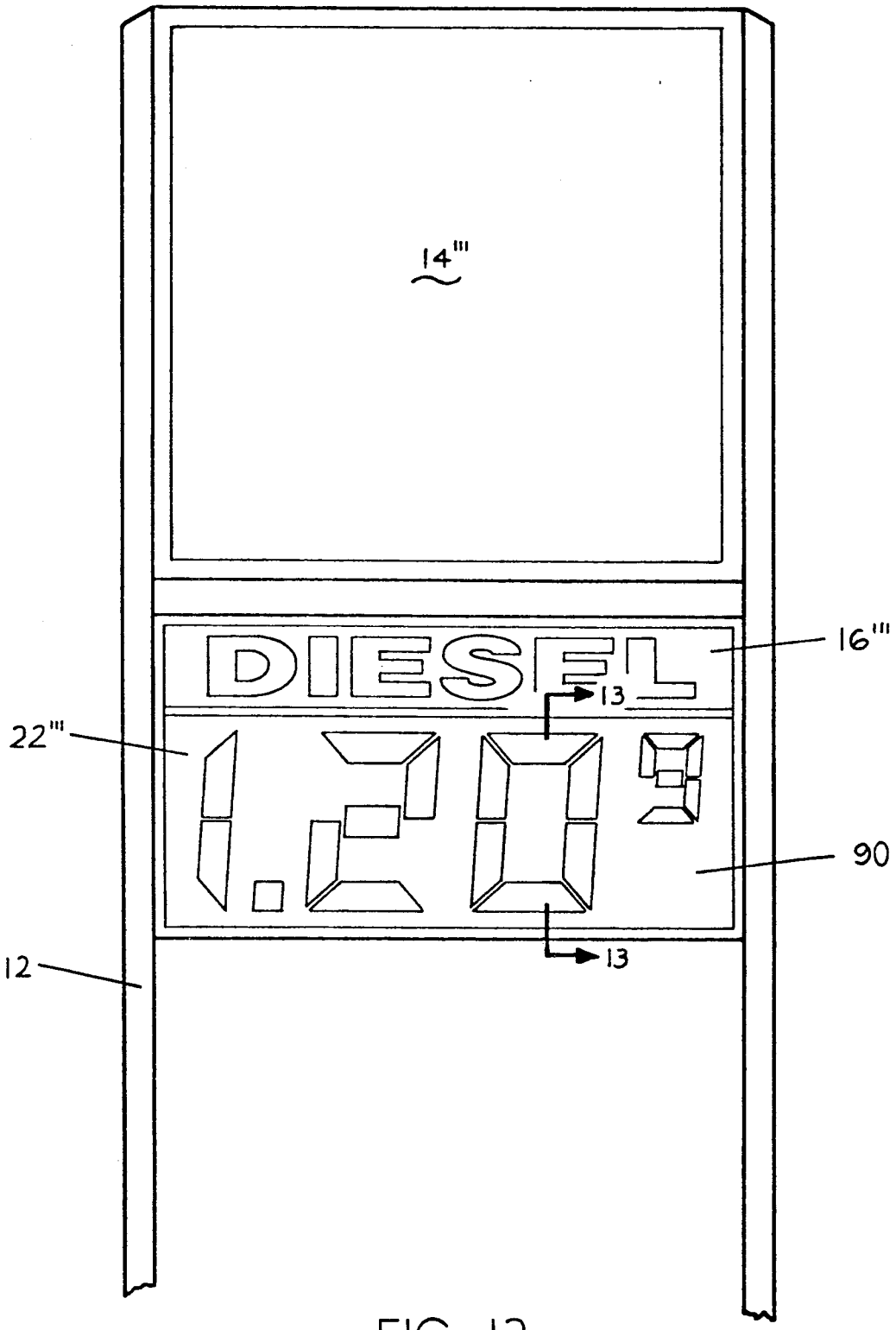
FIG. 12 is a perspective view of a fourth embodiment of a numeral display device in accordance with the present invention.

A further, fourth embodiment 90 and a modification thereof is illustrated in FIGS. 12, 13, 14, 15, 16 and 17. As best seen in FIG. 12, the frame 12''' and background face 22''' from which the numerals contrast would be similar to the previous embodiments discussed. The brand or vendor identification display 14''', as well as the product display 16''', might also be similar to the previously described embodiments.

Figure 13:
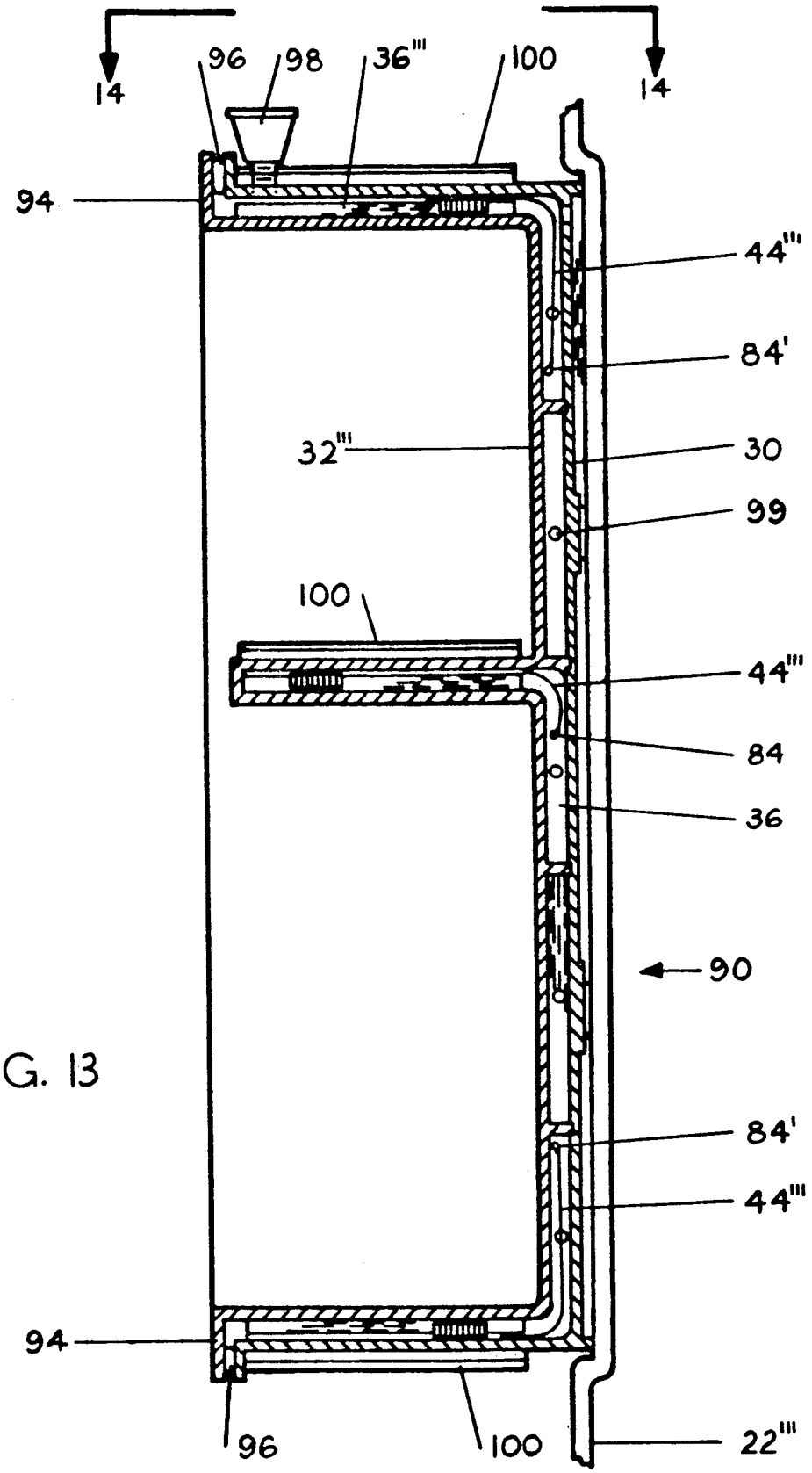
FIG. 13 is a sectional view taken along section line 13—13 of FIG. 12.

FIG. 13 provides a partial sectional view taken along section line 13—13 of FIG. 12. In the embodiment shown in FIG. 13, there are no motors to move the individual films 44'''. A thin metal strip 84' is affixed to each film at its leading, front edge. When a magnet such as magnet 86 (not shown in FIG. 13), is moved near the background face exterior to the display, the metal strip 84' and its accompanying film will be caused to move within the continuous pocket 36'''.

As in the previous embodiments, each pocket is composed of an outer pane 30''' and an inner pane 32'''. Since the outer pane 30''' is composed of a thin plastic material, the magnetic field passes easily through. In the embodiment 90 shown, the edges of the panes forming a pocket are sealed so as to form a liquid-tight pocket.

It has been found in some applications of the invention that the space within the pocket causes some distortion when viewing from the exterior due to refraction of light. Accordingly, the pockets 36''' may be filled with a fluid, which may be transparent, so that the films 44''' or the inner pane 32''' are readily visible. It has been found that by filling with a liquid that is transparent, the distortion is eliminated.

Each of the segments may be formed by a mold process wherein the segments terminate in flanges 94. After liquid has been inserted into the pocket, the flanges are closed with a liquid tight sealant 96.

The embodiment 90 may also include a reservoir tank 98 in fluid communication with the pocket. In the event the pockets 36''' require refilling, the tank 98 has an opening. The tank is positioned so that gravity draws the fluid in the tank into the pockets. The individual pockets 36''' may be interconnected with fluid through holes 99 so that one reservoir tank acts as a supply for all pockets.

In the event that a space exists between the background face 22''' and the outer panes 30''', fluid may also be placed therebetween.

Figure 14:
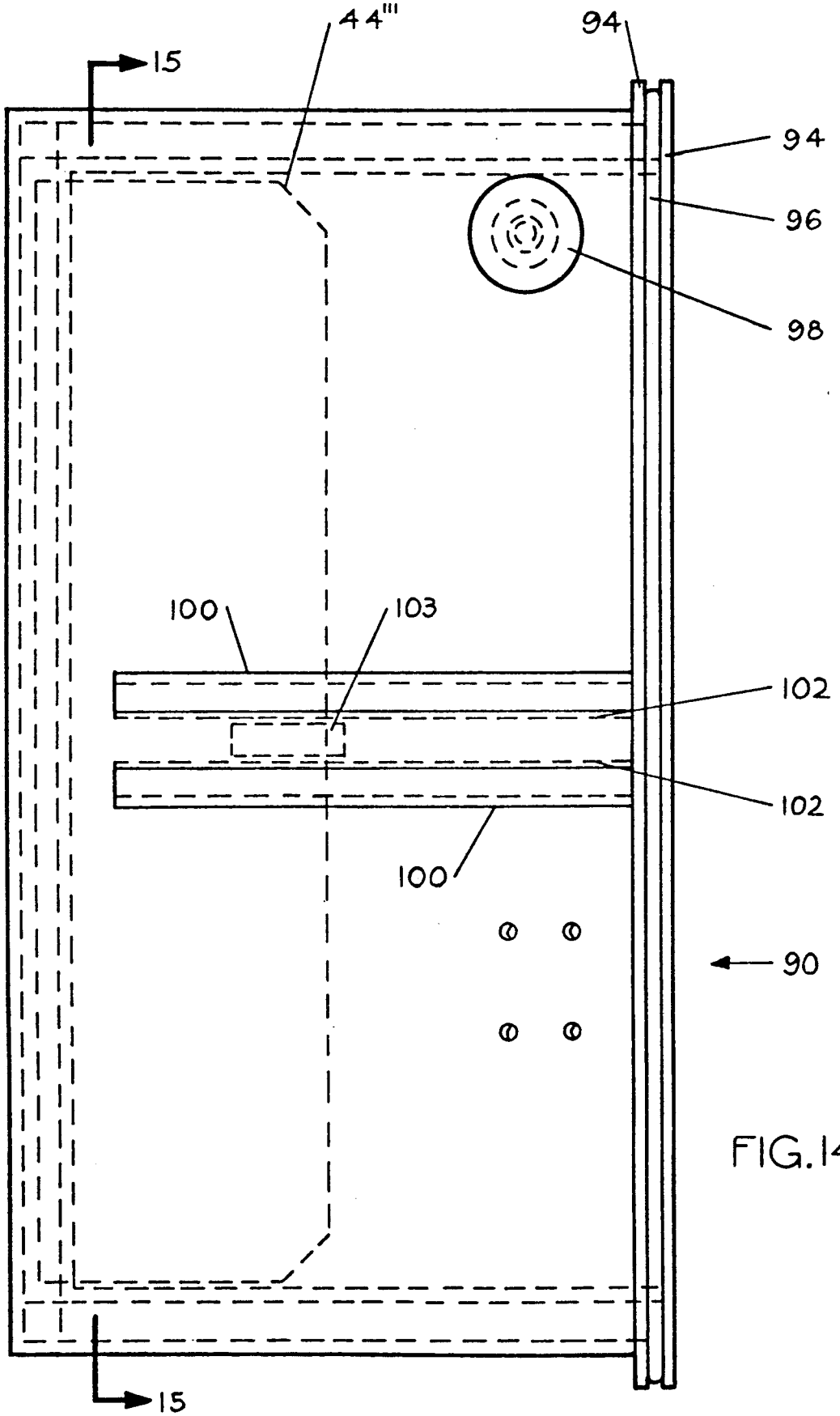
FIG. 14 is a partial sectional view taken along section line 14—14 of FIG. 13.

FIG. 14 shows a partial sectional view taken along section line 14—14 of FIG. 13. An optional magnet track 100 shown will be described in connection with a further modification. Within each pocket 36''' extending from one of the panes is a corresponding interior track 102. The magnet track 100 is parallel to and aligned with the interior track 102. A metal guide 103 affixed to the film 44''' is allowed to travel within the interior track 102. The back flanges 94 as well as the sealant therebetween can readily be seen.

Figure 15:
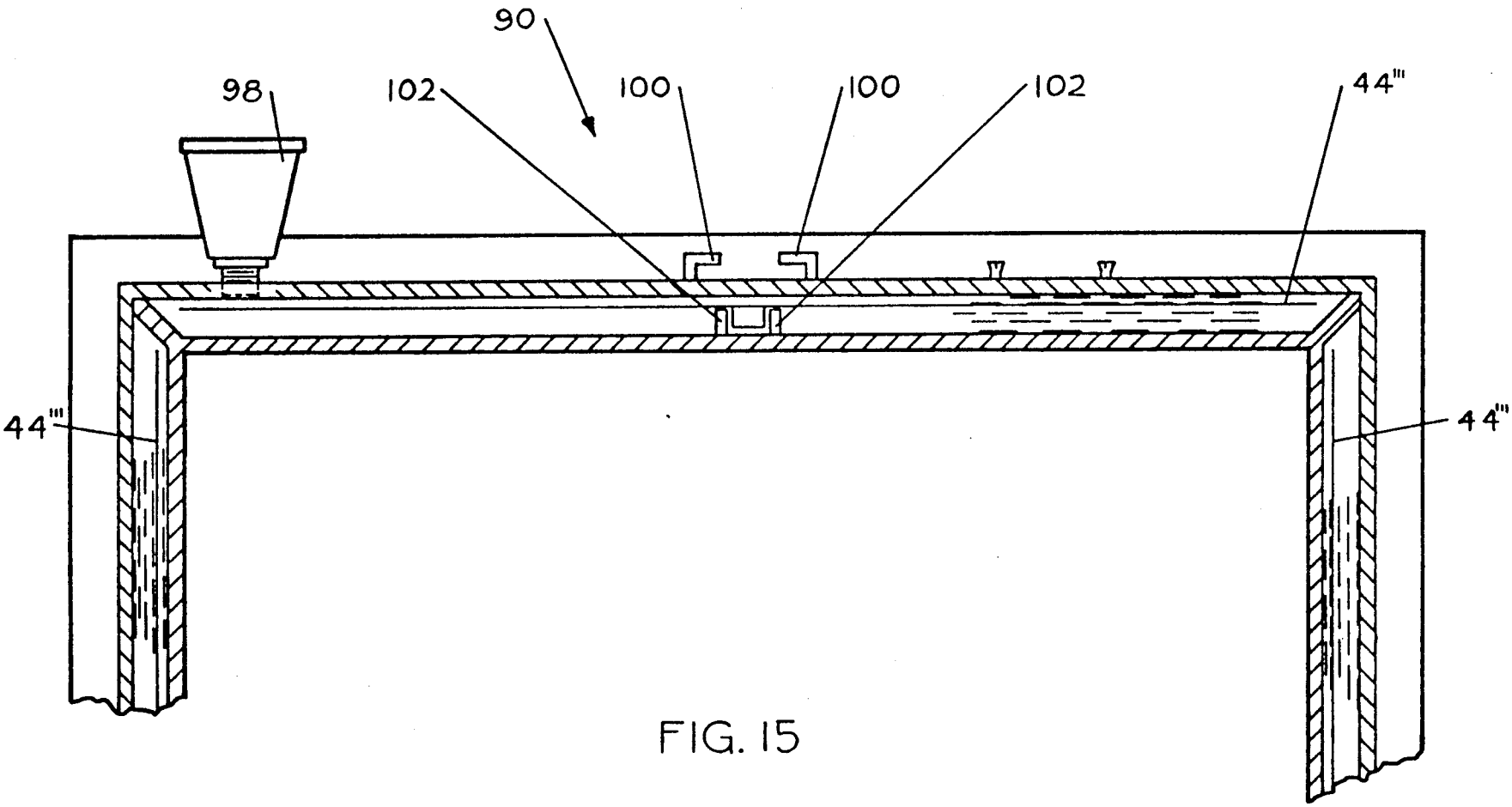
FIG. 15 is a partial sectional view taken along section line 15—15 of FIG. 14.

FIG. 15 is a partial sectional view taken along section line 15—15 of FIG. 14. The guide rails of the tracks 100 and 102 can easily be seen in FIG. 15.

Figure 16:
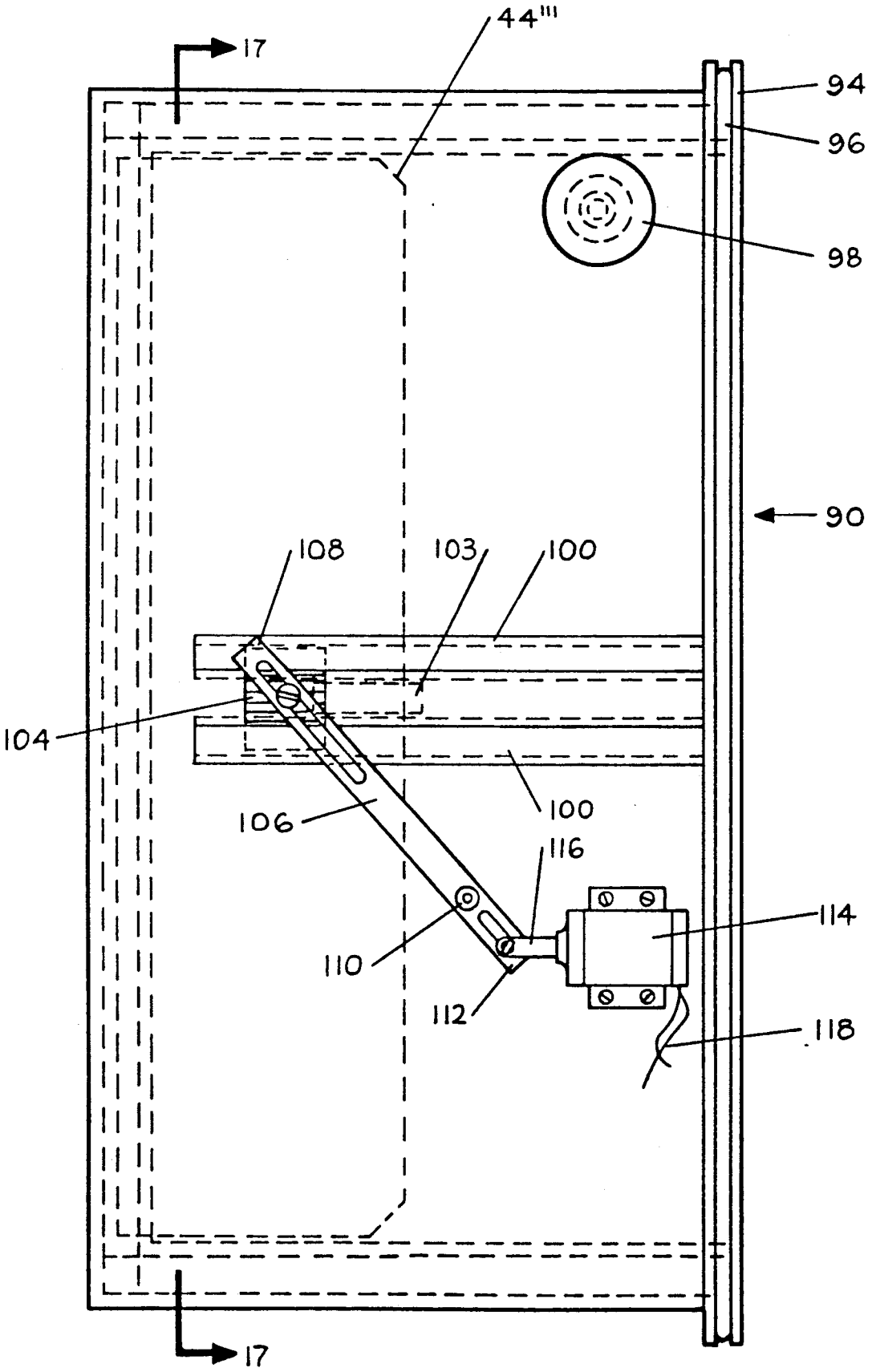
FIG. 16 illustrates a modification of the embodiment of the invention shown in FIG. 12.
Figure 17:
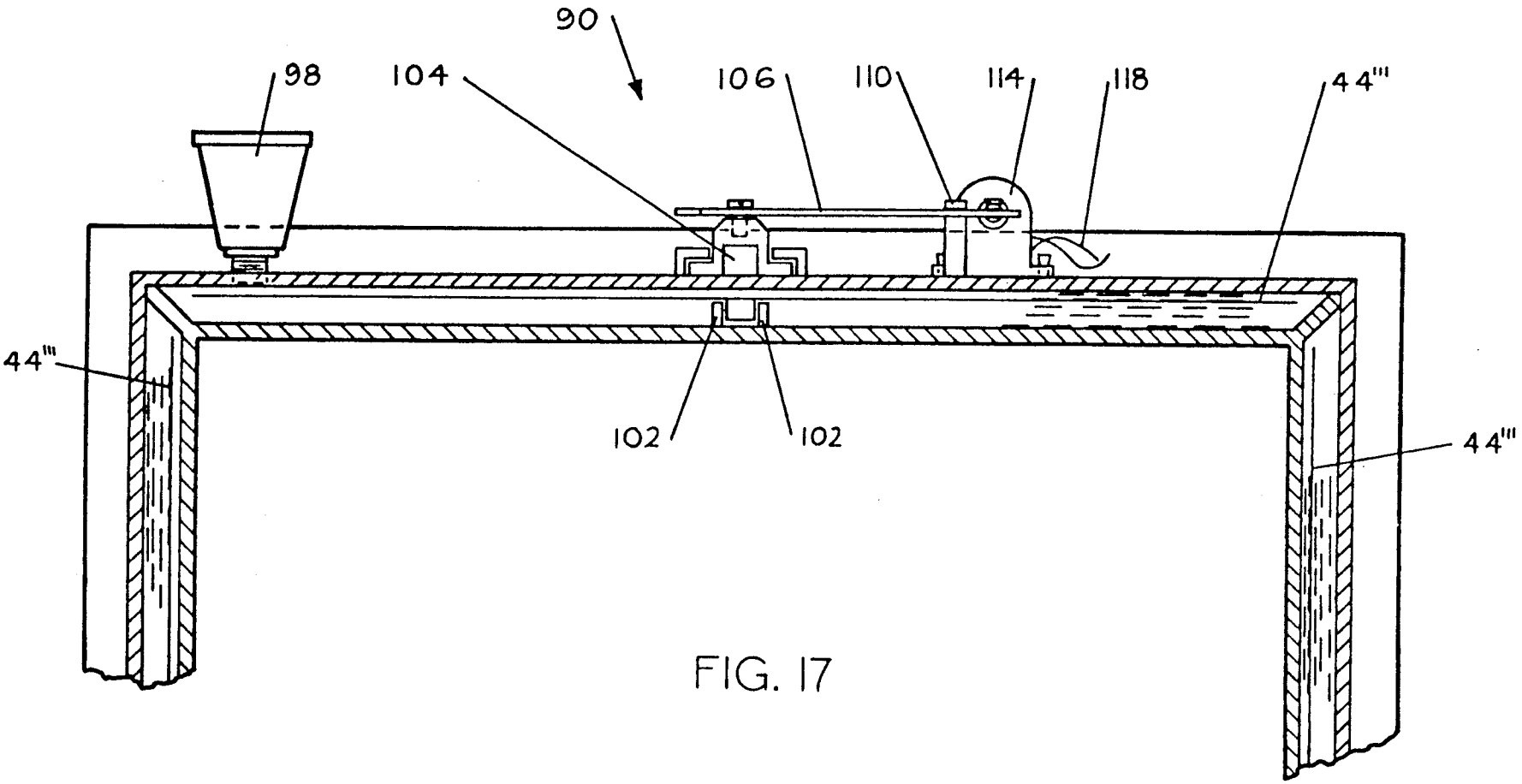
FIG. 17 is a partial sectional view taken along section line 17—17 of FIG. 16.

FIGS. 16 and 17 provide a further modification on the embodiment shown in FIGS. 13, 14 and 15. A mechanized means is provided to move the film 44''' within each fluid filled pocket 36'''. A magnet 104 is allowed to travel slidably within the magnet track 100. As the magnet moves within the track, the magnetic field will cause the metal guide 103 attached to the film to move. Accordingly, as the magnet 104 moves, the film 44''' will move within the pocket.

An actuator arm 106 has one end 108 pivotally mounted to the magnet 104. The actuator arm is allowed to move about a pivot 110 located between the ends of the actuator arm. The pivot 110 is affixed to the outer pane 30'''. The opposite end 112 of the actuator arm 106 is pivotally connected to an electric motor 114. The electric motor drives a shaft 116 which moves the shaft axially. The shaft might have a screw thread (not shown) which translates rotational movement to axial movement. Axial movement of the shaft 116 will cause the end 112 of the actuator arm to move, thereby causing a corresponding action of the opposite end 108 of the actuator arm. Accordingly, the magnet attached to the actuator arm 108 will move within the track 100. Movement of the magnet 104 within the track 110 will cause movement of the metal guide 103 attached to the film 44'''. The motor 114 might be run on low voltage direct current or, alternatively, by household alternating current and attached to a power source by lines 118.

The electric motor 114 might be connected to a control mechanism (not shown) which will control power to the motor and control its direction. The control mechanism will control each motor corresponding to the seven segments that comprise a numeral.

A salient feature of the present embodiment may be observed if the electric motor 114 or actuator arm 106 malfunctions. An operator may manually manipulate a magnet 86 exterior to the display. If strong enough, the magnet 86 will attract the metal strip 84' and separate the metal guide 103 from the magnet 104. Accordingly, the film may be inserted or withdrawn manually even if the mechanized means for doing so fails.

Whereas, the present invention has been described in particular relation to the drawings attached hereto, it should be understood that other and further modifications, apart from those shown or suggested herein may be made within the spirit and scope of this invention.

What is claimed is:

1. A numeral display device having at least one visible face which comprises:

a. a plurality of segments, each segment having a transparent outer pane and a spaced, parallel inner pane, said outer pane and said inner pane forming a pocket, a first portion of said pocket being aligned with and visible in said face and a second portion of said pocket in angular relation to said first portion;

b. a plurality of flexible films, one said film received in each said pocket; and c. means to slidably insert and withdraw each said film from each said first portion of each said pocket, each said pocket adapted to guide each said film as it travels therethrough and each said pocket being liquid tight and filled with a transparent liquid, so that each said segment will either contrast with or match said face.

2. A numeral display device as set forth in claim 1 including at least one liquid reservoir tank, said tank in fluid communication with at least one of said pockets, and said tank arranged so that gravity draws said liquid from said tank into said pocket.

3. A numeral display device as set forth in claim 2 wherein said pockets are fluidly connected to each other so that gravity will draw fluid from said tank to keep all said pockets filled.

4. A numeral display device as set forth in claim 1 wherein said liquid is resistant to freezing and evaporation.

5. A numeral display device having at least one visible face which comprises:

a. a plurality of segments, each segment having a transparent outer pane and a spaced, parallel inner pane, said outer pane and said inner pane forming a pocket, a first portion of said pocket being aligned with and visible in said face and a second portion of said pocket in angular relation to said first portion;

b. a plurality of flexible films, one said film received in each said pocket; and c. means to slidably insert and withdraw each said film from each said first portion of each said pocket, each said pocket adapted to guide each said film as it travels therethrough, so that each said segment will either contrast with or match said face, said means to slidably insert and withdraw including a plurality of motor means, each said motor means having an axially reciprocal shaft and wherein said means to slidably insert and withdraw includes an actuator arm having two ends movable about a pivot, said shaft engaging one end of said actuator arm, the opposite end of said actuator arm terminating in a magnet and wherein a metal guide affixed to each said film will move in response to movement of said magnet so that axial movement of said shaft will translate to movement of said film.

* * * * *